US009214761B2

(12) United States Patent
Mueller et al.

(10) Patent No.: US 9,214,761 B2
(45) Date of Patent: Dec. 15, 2015

(54) PLUG-IN CONNECTOR HAVING A CABLE SHEATH WITH TWO PARTS ADJUSTABLE IN DIFFERENT POSITIONS RELATIVE TO EACH OTHER

(71) Applicant: MCQ TECH GmbH, Blumberg (DE)

(72) Inventors: Hartmut Mueller, Braeunlingen (DE); Eduard Becker, Weigheim (DE)

(73) Assignee: MCQ TECH GmbH, Blumberg (DE)

( * ) Notice: Subject to any disclaimer, the term of this patent is extended or adjusted under 35 U.S.C. 154(b) by 0 days.

(21) Appl. No.: 14/200,351

(22) Filed: Mar. 7, 2014

(65) Prior Publication Data

US 2014/0295695 A1 Oct. 2, 2014

(30) Foreign Application Priority Data

Mar. 12, 2013 (DE) ..... 10 2013 204 203

(51) Int. Cl.
*H01R 13/58* (2006.01)
*H01R 24/64* (2011.01)

(52) U.S. Cl.
CPC ..... *H01R 13/5829* (2013.01); *H01R 13/5841* (2013.01); *H01R 24/64* (2013.01)

(58) Field of Classification Search
CPC ..... H01R 13/5829; H01R 13/5804; H01R 13/5816; H01R 13/582
USPC ..... 439/450–473
See application file for complete search history.

(56) References Cited

U.S. PATENT DOCUMENTS

| | | | | |
|---|---|---|---|---|
| 5,961,344 | A * | 10/1999 | Rosales et al. | 439/495 |
| 6,315,599 | B1 * | 11/2001 | Daoud | 439/459 |
| 6,544,070 | B1 * | 4/2003 | Radliff | 439/596 |
| 6,843,682 | B2 * | 1/2005 | Matsuda et al. | 439/596 |
| 6,907,122 | B2 * | 6/2005 | Chiang et al. | 379/438 |
| 7,086,875 | B2 * | 8/2006 | Hoffmann | 439/119 |
| 7,614,903 | B1 * | 11/2009 | Huang | 439/446 |
| 2004/0252828 | A1 | 12/2004 | Chiang | |
| 2012/0100745 | A1 | 4/2012 | Myong et al. | |

FOREIGN PATENT DOCUMENTS

| | | | |
|---|---|---|---|
| DE | 29804543 | U1 | 7/1998 |
| DE | 10 2007 018 945 | A1 | 10/2008 |
| DE | 202011022286 | U1 | 5/2012 |
| EP | 1 460 733 | A2 | 3/2004 |

* cited by examiner

*Primary Examiner* — Chandrika Prasad
(74) *Attorney, Agent, or Firm* — Juneau & Mitchell

(57) ABSTRACT

The invention relates to a plug-in connector for a data or telecommunication cable comprising several wires with a contact carrier, comprising connection contacts for a plug-in connection and with connecting contacts, connected thereto in an electrically-conducting fashion, for the wires of the cable, and with an accepting screen.

18 Claims, 9 Drawing Sheets

Schnitt A-A

PLUG-IN CONNECTOR HAVING A CABLE SHEATH WITH TWO PARTS ADJUSTABLE IN DIFFERENT POSITIONS RELATIVE TO EACH OTHER

CROSS REFERENCE TO RELATED APPLICATIONS

This patent application claims priority German Patent Application 10 2013 204 203.5, filed on Mar. 12, 2013.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

1. Field of the Invention

The invention relates to a plug-in connector for data and/or telecommunications cable comprising several wires.

2. Background of the Invention

The current state of knowledge is as follows.

Plugs are known, which comprise a cable outlet positioned on the axis of the plug-in direction. Such a plug is known for example from DE 10 2006 010 279 A1. The same also applies frequently for connection sockets with cables connected thereto, with such a connection socket being discernible for example from EP 1 336 225 B1. In the following, both plugs as well as connection sockets shall be summarized under the term plug-in connector.

So-called RJ45-plug-in connectors are known, which are used particularly in data and telecommunication technology, for example for establishing ethernet connections.

Sometimes, plug-in connectors with a cable outlet bent at an angle of 90° in reference to the plug-in direction are also used in industrial environments. In order to produce such cable outlets the cables projecting from the plug-in connector housing are bent in the desired direction and held in this position by cable extrusion or by a mechanic cable guiding sheath. However, when bending the cable it is frequently kinked, which leads to poorer transmission characteristics of the cable and reduced reliability.

The objective of the invention is to provide a cable guide for a plug-in connector, which allows various outlet directions of the cable without kinking the cable.

BRIEF SUMMARY OF THE INVENTION

In a preferred embodiment, a plug-in connector for a data and/or telecommunication cable comprising several wires with a contact carrier, comprising connection contacts for a plug-in connection and with connecting contacts, connected thereto in an electrically-conducting fashion for the wires of the cable, and with an notched housing, which comprises notches for the wires, whereby during the assembly of the contact carrier and the notched housing the electrically-conductive contact can be established between the wires arranged in the notches and the connecting contacts, wherein a cable sheath is arranged at the plug-in connector, which comprises a first part and a second part, with the first part showing a first longitudinal axis and the second part a second longitudinal axis, with the first part being fixed in reference to plug-in connector in at least two different positions, distorted about the first longitudinal axis, with the second part being fixed in reference to the first part in at least two different positions, distorted about a rotary axis, and with the first longitudinal axis and the second longitudinal axis being arranged in at least one of the different fixed positions of the cable sheath at an angle of 0° in reference to each other.

In another preferred embodiment, the plug-in connector as described, wherein the first part comprises a first contact area for contacting the second part and that the second part comprises a second contact area for contacting the first part, with the first contact area being arranged at a first angle from 0° to 90° in reference to the first longitudinal axis and with the second contact area being arranged at a second angle from 9° to 90° in reference to the second longitudinal axis.

In another preferred embodiment, the plug-in connector as described, wherein the rotary axis extends perpendicular to the first contact area and/or the second contact area.

In another preferred embodiment, the plug-in connector as described, wherein the first angle and/or the second angle range from 30° to 60°, preferably comes to approximately 45°.

In another preferred embodiment, the plug-in connector as described, wherein the first part can be fixed at the plug-in connector in four different positions distorted about the first longitudinal axis.

In another preferred embodiment, the plug-in connector as described, wherein the first part comprises at its end facing the plug-in connector a cylindrical section with a cross-section showing at least a two-fold rotary axis, preferably an essentially square cross-section.

In another preferred embodiment, the plug-in connector as described, wherein the first part can be fixed at the plug-in connector via a latching connection.

In another preferred embodiment, the plug-in connector as described, wherein the second part can be fixed at the first part in four to twelve, preferably in eight different positions, distorted about the rotary axis.

In another preferred embodiment, the plug-in connector as described, wherein one of the two parts shows at its end facing the other one of the two parts a cylindrical section with an outer or inner contour with at least a two-fold rotary axis, preferably a polygon, particularly an octagon, and the other of the two parts comprises at its end facing one of the two parts a cylindrical section complementary to the cylindrical section of one of the two parts.

In another preferred embodiment, the plug-in connector as described, wherein at least one of the two parts shows two elements, pivotal in reference to each other about a pivotal axis, which extends particularly parallel in reference to the second longitudinal axis.

In another preferred embodiment, the plug-in connector as described, wherein each of the two elements shows a partial section of the cylindrical section.

In another preferred embodiment, the plug-in connector as described, wherein the two elements can be connected via a latching connection.

In another preferred embodiment, the plug-in connector as described, wherein the two elements can be connected to each other via a pin.

In another preferred embodiment, the plug-in connector as described, wherein one of the two parts shows a collar extending outwardly and that the other one of the two parts shows a collar extending inwardly.

In another preferred embodiment, the plug-in connector as described, wherein the cable guiding sheath, particularly the second part of the cable guiding sheath, comprises a strain relief.

In another preferred embodiment, the plug-in connector as described, wherein the cable guiding sheath is embodied in an electrically conductive fashion.

In another preferred embodiment, the plug-in connector as described, wherein the cable guiding sheath, particularly the second part of the cable guiding sheath, comprises a screen removal spring.

In another preferred embodiment, the plug-in connector as described, wherein the cable guiding sheath, particularly the first part of the cable guiding sheath, comprises a screen transfer spring.

DETAILED DESCRIPTION OF THE INVENTION

Figure 1:
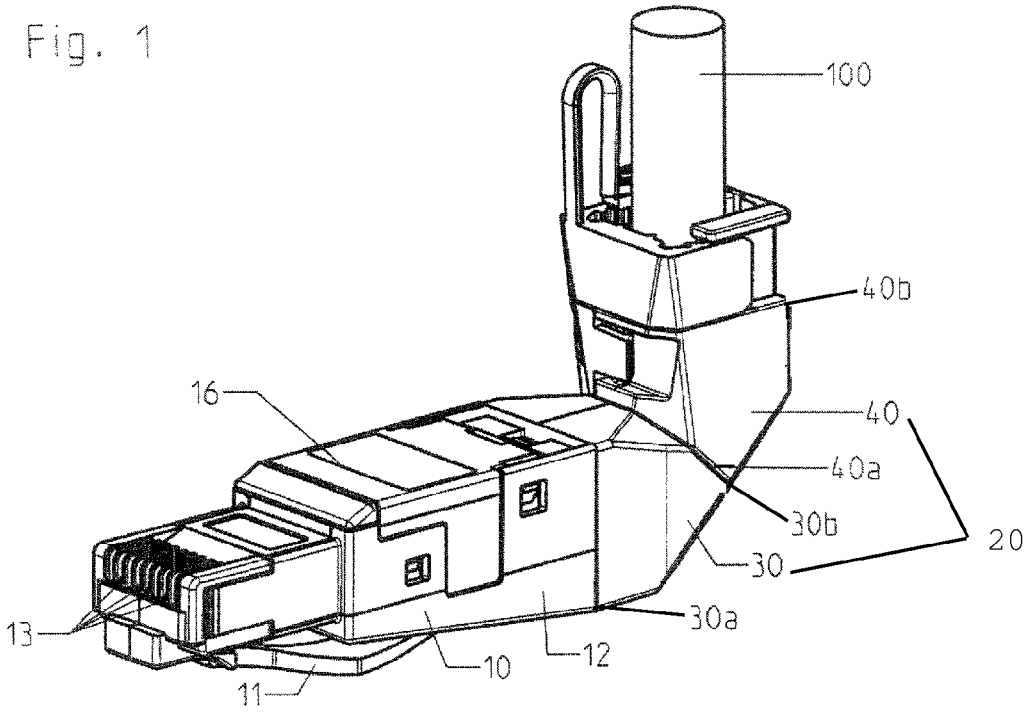
FIG. 1 is a line drawing evidencing a perspective view of an exemplary embodiment of a plug-in connector with a cable sheath and an inserted cable.

The inventive plug-in connector for a data and/or telecommunication cable comprising several wires with a contact carrier, comprising connection contacts for a plug-in connection and with connecting contacts, connected thereto in an electrically-conducting fashion, which may be embodied as insulation displacement contacts, for example, for the wires of the cable, and with an notched housing, which accepts the wires, which during the assembly of the contact carrier and the notched housing the electrically-conductive contact can be established between the wires arranged in the notches and the connecting contacts, is characterized in that a cable sheath is arranged at the plug-in connector, which comprises a first part and a second part, with the first part showing a first longitudinal axis and the second part a second longitudinal axis, where the first part can be fixed in reference to plug-in connector, particularly thereat, in at least two different positions, distorted about a rotary axis, where the second part can be fixed in reference to the first part, particularly thereat, in at least two different positions, distorted about a rotary axis, and with the first longitudinal axis and the second longitudinal axis being arranged in at least one of the different fixed positions of the cable sheath at an angle of 0° in reference to each other. In this way it is possible that upon rotation of the first part in reference to the plug-in connector about the first longitudinal axis and upon rotation of the second part in reference to the first part about a rotary axis the direction of the cable outlet is rendered variable. Furthermore, the cable sheath, embodied in two pieces, with two parts rotational in reference to each other, allows that the sheath of the cable comprising several wires already in the rear, in the present case second part of the cable sheath such that only the wires of the second part are guided through the first part to the plug-in connector and this way any kinking of the cable is avoided, which can lead to poorer transmission characteristics of the conductors. It shall be emphasized that a plug-in connector in the sense of the present invention includes both a plug as well as a socket.

A preferred embodiment of the invention provides that the first part comprises a first contact area to contact the second part and that the second part comprises a second contact area to contact the first part, with the first contact area being arranged in a first angle from 0° to 90° in reference to the first longitudinal axis and with the second contact area in a second angle from 0° to 90° in reference to the second longitudinal axis. In other words, the end of the first part facing the second part and the end of the second part facing the first part are slanted such that upon the assembly of the ends facing each other in different positions relative to each other, various options are given to change the direction of the cable outlet. Here, the rotary axis extends particularly perpendicular in reference to the first contact area and/or the second contact area.

Preferably the first angle and/or the second angle range from 30° to 60°, approximately 45° is particularly preferred. This way, in particular, a cable outlet at an angle of 90° is possible in various directions, for example towards the right or the left.

Preferably the first part can be fixed at the plug-in connector in four different positions, distorted about the first longitudinal axis, in order to allow a change in the direction in the four spatial directions perpendicular to the plug-in direction.

Preferably, the first part comprises at its end, facing the plug-in connector, a cylindrical section with a cross-section with an at least two-fold axis of rotation, preferably an essentially square cross-section. This allows in a particularly easy structural design a fixation in various positions, distorted about the first longitudinal axis. Here, a n-fold rotary axis, with n being an integer greater than 1, shall be understood as a rotary axis about which the cross-section is rotated and can then be matched with itself upon a rotation by 360°/n.

Advantageously, the first part can be fixed to the plug-in connector by way of a latch connection. This allows a particularly easy fixation.

According to a preferred embodiment of the invention the second part can be fixed at the first part in four to twelve, preferably eight different positions, distorted about the rotary axis. In a combination with four different positions, distorted about the first longitudinal axis, between the first part and the plug-in connector a total of 32 possible shapes develop for the cable outlet so that in a simple and flexible fashion very different outlet directions are possible, which however allow the use of the plug-in connector also at higher packing density, for example in so-called multi-port sockets.

According to a particularly preferred embodiment of the invention one of the two parts comprises, at the end facing the respectively other one of the two parts, a cylindrical section with an outer or inner contour showing at least a two-fold rotary axis, preferably the outer or inner contour of a polygon, particularly an octagon, and the other one of the two parts shows at its end, facing one of the two parts, a cylindrical section, which is complementary to the cylindrical section of one of the two parts. This way a compact torque-proofing and fixation in the desired position is possible A preferred embodiment of the invention provides that at least one of the two parts comprises elements pivotal in reference to each other about a pivotal axis, which extends particularly parallel in reference to the second longitudinal axis. This way it is possible that the respective part can subsequently be fastened around the wires or the sheath. When, for example, the second part shows two elements, pivotal in reference to each other about a pivotal axis, it is possible that the second part, after the wires have been guided through the first part and the wires of the cable have been fastened in the notched housing, can subsequently be fastened about the wires and the end of the sheath.

According to an advantageous embodiment of the invention each of the two elements comprises a portion of a cylindrical section. The two elements may be embodied as half-shells, for example.

The two elements may be produced particularly from metal, in order to allow an insulating effect.

It is particularly preferred that the two elements can be connected via a latching connection, which allows a simple fastening.

Beneficially the two elements are connected pivotally in reference to each other via a pin. This allows particularly the production of the two elements from a material which is not, or is hardly, elastic.

According to a particularly preferred embodiment of the invention, one of the two parts comprises a collar extending outwardly and the other of the two parts a collar extending inwardly in order to, in this way, allow an axial fixation of the two parts in reference to each other in a compact design.

Preferably, the cable guiding sheath, particularly the second part of the cable guiding sheath, shows a strain relief, for example in the form of a strain relief claw, in order to avoid damaging the electric contact between the wires of the cable and the plug-in connector in case of stress being applied.

An advantageous further development of the invention provides that the cable guiding sheath is embodied in an electrically-conductive fashion in order to allow it to act as a screen.

Advantageously the cable guiding sheath, particularly the second part of the cable guiding sheath, comprises a screen removal spring, in order to allow connecting the cable screen with the cable guiding sheath. The arrangement of the screen removal spring already in the second part of the cable guiding sheath allows an insulation of the cable and a removal of the cable screen already in the second part, such that only the wires and, to the extent present, the paired screen must be guided into the first part and any kinking of the cable sheath can be avoided.

According to a preferred embodiment of the invention the cable guiding sheath, particularly the first part of the cable guiding sheath, comprises a screen transfer spring, in order to allow a connection of the screen of the plug-in connector to the cable guiding sheath.

DETAILED DESCRIPTION OF THE FIGURES

FIGS. 1 to 18 show different views of an exemplary embodiment of a plug-in connector 10 as well as various components of the plug-in connector 10, whereby, for better clarity, not all refer-ence characters are represented in all figures.

Figure 17:
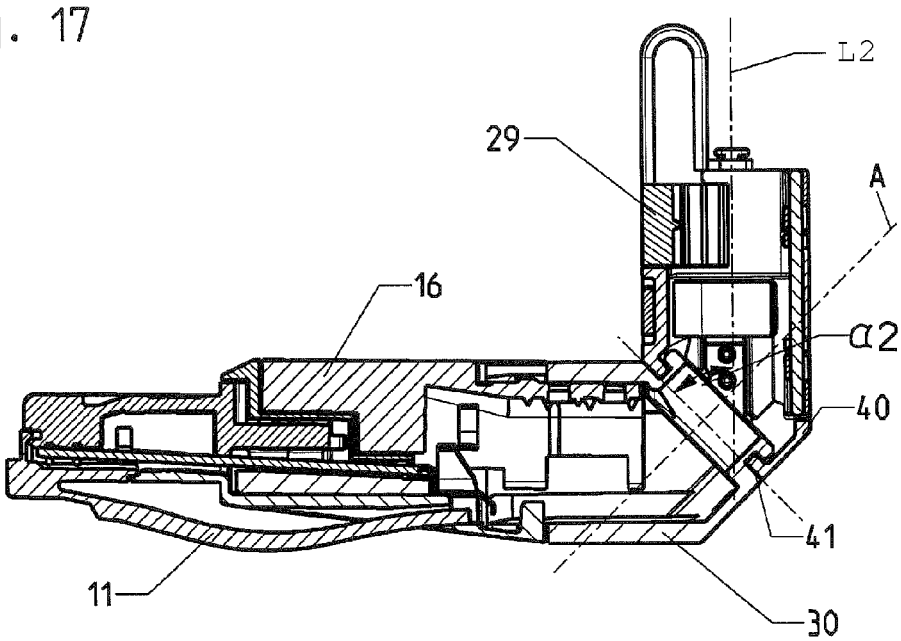
FIG. 17 is a line drawing evidencing a longitudinal cross-section through the plug-in connector according to FIG. 1.
Figure 18:
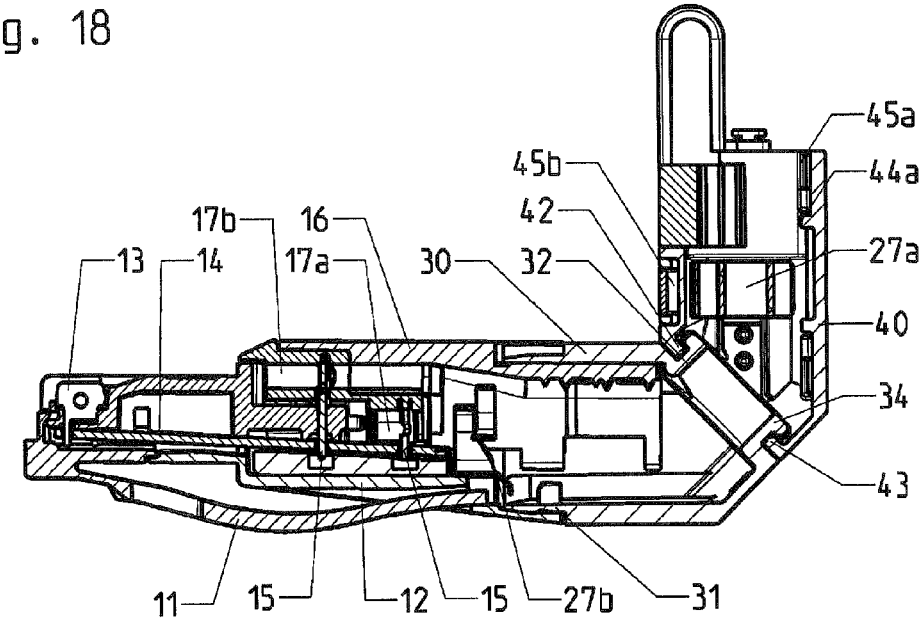
FIG. 18 is a line drawing evidencing another longitudinal cross-section, parallel off-set in reference to the longitudinal cross-section according to FIG. 17, of the plug-in connector according to FIG. 1.

As is particularly discernible from FIGS. 17 and 18, the plug-in connector 10 comprises a contact carrier 12 and an notched housing 16, with the contact carrier 12 comprising several connection contacts 13 and with the connection contacts 13 comprising connection contacts 15, connected in an electrically-conducting fashion via connection lines arranged in or on a circuit board 14, which may be embodied as insulation displacement connectors, for example. The plug-in connector 10 is used as a plug. The connecting contacts 13 therefore establish an electrically-conductive connection to the socket when the plug is inserted into a socket. The connecting contacts 15 serve to establish an electrically-conductive connection to wires 102 of a cable 100, as described in greater detail in the following.

The notched housing 16, which is particularly shown in detail in FIGS. 11 through 14, comprises several notches 17, where one wire 102 of the cable 100 can be inserted into each of the notches 17. The notched housing 16 comprises as notches 17 on the one side grooves 17*a*, which are open towards one side, and on the other side penetrations 17*b*, into which the wires 102 can be inserted from one end. The grooves 17*a* are here arranged in a level, which is arranged parallel and offset in reference to a level in which the penetrations 17*b* are arranged. In order to connect the cable 100 to the notched housing, the cable sheath is removed and the wires 102 are inserted into the notches 17, particularly into the grooves 17*a* and the penetrations 17*b*. Each of the notches 17 is crossed by a slot 18, in which upon placement of the notched housing 16 onto the contact carrier 12 the connecting contacts 15, embodied as insulation displacement connectors, engage and hereby establish the electrically-conductive contact between the wires 102 arranged in the notches 17 and the connecting contacts 13. As particularly discernible from FIGS. 12 and 1, the notched housing 16 latches onto the contact carrier 12. For this purpose, the notched housing 16 comprises of latching projections 19, which engage latch recesses 12*a* arranged at the housing of the contact carrier 12.

At the plug-in connector 10, particularly at the contact carrier 12, a latching lever 11 may be arranged for securing the plug-in connector 10 inserted in a socket.

A cable sheath 20 is arranged at the plug-in connector 10 (cf. particularly FIGS. 1 to 5), comprising a first part 30 and a second part 40. The first part 30 comprises a front end 30*a* facing the plug-in connector 10 and a rear end 30*b* facing the second part 40, while the second part 40 comprises a front end 40*a* facing the first part 30 and a rear end 40*b* facing away from the first part 30. The first part 30 shows a first longitudinal axis L1. The second part 40 shows a second longitudinal axis L2.

The first part 30 can be fixed in several positions at the plug-in connector 10, distorted about the first longitudinal axis L1 (cf. particularly FIGS. 1 to 5). For fixation purposes, the first part 30 comprises at the plug-in connector 10, at its front end 30*a*, a first cylindrical section 31 (cf. particularly FIGS. 7 to 8), which shows essentially a square cross-section and is particularly embodied symmetrically such that when respectively rotated by 90° a total of four different positions can be arranged in reference to the plug-in connector 10 fixed at said plug-in connector 10 (cf. FIGS. 11 to 14). As particularly discernible in FIG. 12, for fixation purposes at the first cylindrical section 31 of the first part 30 in each of the four side areas of the cylindrical section 31 with a square cross-section, a latch opening 31*a* may be arranged, with latching projections 19*a* arranged at the notched housing 16 which may engage it in order to establish a latching connection.

Figure 9:
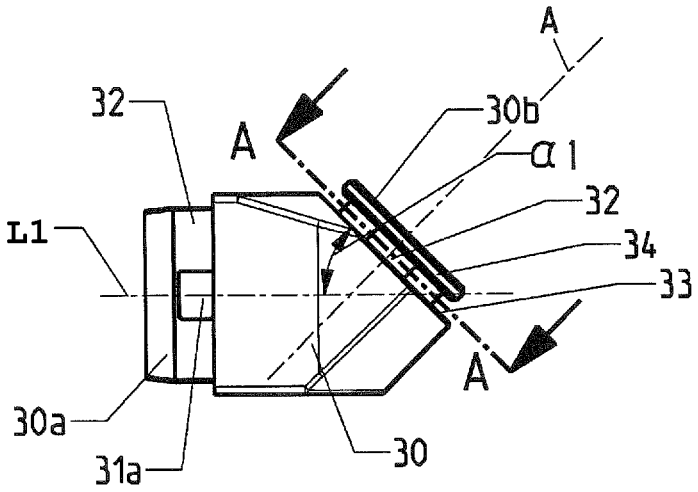
FIG. 9 is a line drawing evidencing a side view of the first part according to FIG. 7.
Figure 10:
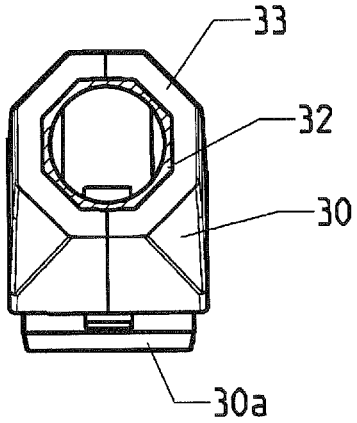
FIG. 10 is a line drawing evidencing a cross-section through the first part according to the line A-A in FIG. 9.
Figure 11:
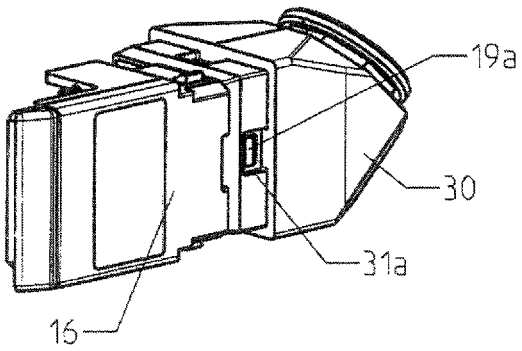
FIG. 11 is a line drawing evidencing the first part of the cable sheath of the plug-in connector according to FIG. 1 with an notched housing fastened thereat in a first position.
Figure 12:
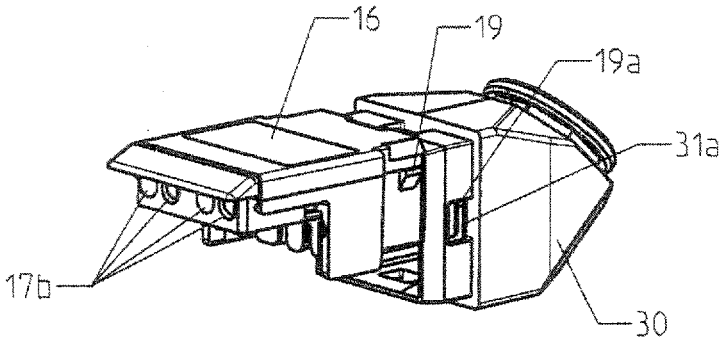
FIG. 12 is a line drawing evidencing the first part of the cable sheath of the plug-in connector according to FIG. 1 with an notched housing fastened thereat in a second position.
Figure 13:
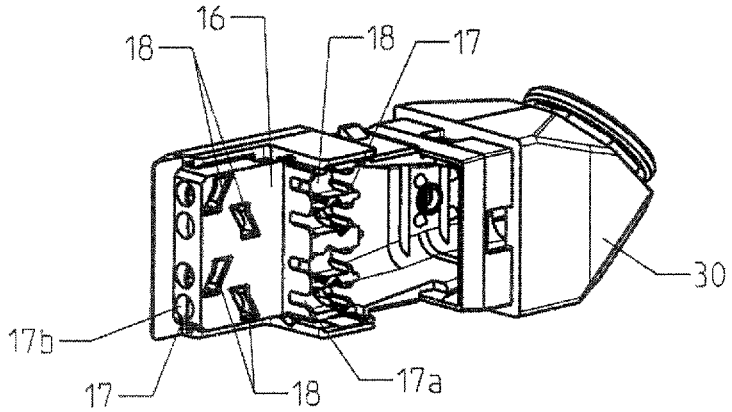
FIG. 13 is a line drawing evidencing the first part of the cable sheath of the plug-in connector according to FIG. 1 with an notched housing fastened thereat in a third position.
Figure 14:
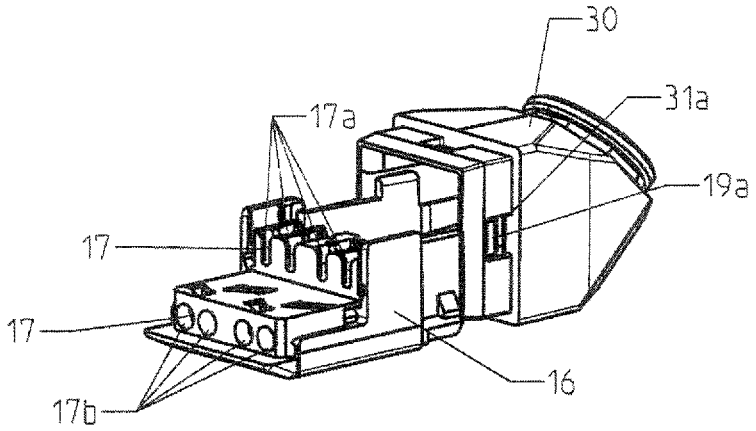
FIG. 14 is a line drawing evidencing the first part of the cable sheath of the plug-in connector according to FIG. 1 with an notched housing fastened thereat in a fourth position.
Figure 15:
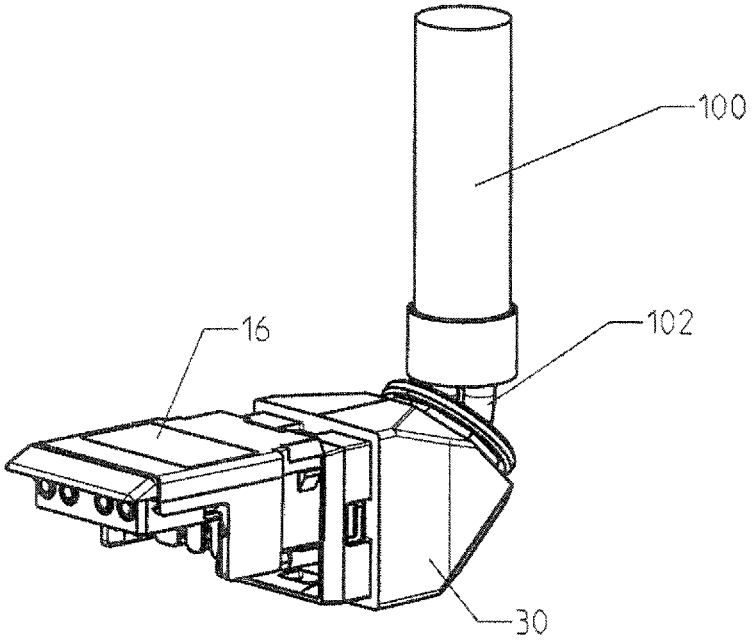
FIG. 15 is a line drawing evidencing the first part of the cable sheath with an notched housing fastened thereat according to FIG. 12 and an inserted cable.
Figure 16:
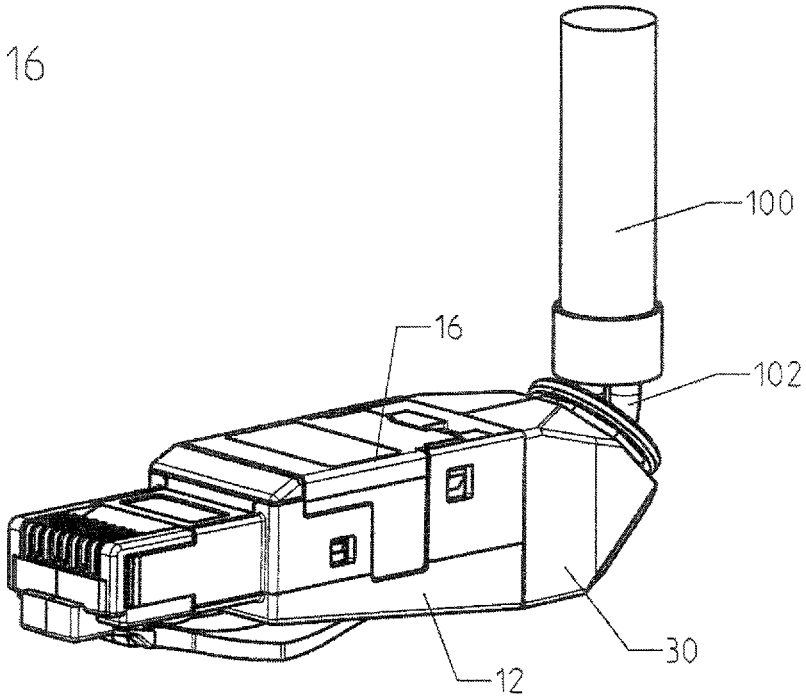
FIG. 16 is a line drawing evidencing the first part of the cable sheath with an notched housing and a cable according to FIG. 15 as well as a contact carrier fastened at the notched housing.

The first part 30 comprises a first contact area 33 in the area of its rear end 30*b* for contacting the second part 40, which is arranged at a first angle ca from 0° to 90°, for example at an angle ca of 45°, in reference to the first longitudinal axis L1 (cf. particularly FIG. 9). In other words, the rear end 30*b* is slanted in reference to the first longitudinal axis L1. By distorting the first part 30 in reference to the notched housing 16, a variation of the outlet alignment can be allowed in reference to the outlet direction defined by the first contact area 33.

The wires 102 of the cable 100 to be connected are inserted through the rear end 30*b* into the first part 30, guided out of the first part 30 through the front end 30*a*, and fastened in the notched housing 16. The sheath of the cable 100 already ends before the first part 30 and is not inserted into the first part 30. After the wires 102 are inserted into the notched housing 16, the first part 30 can be fixed in the desired relative alignment in reference to the notched housing 16 at the notched housing 16 via the latching connection (see FIG. 15).

In order to connect to the second part 40, the first part 30 comprises a second cylindrical section 32 arranged in an area of the rear end 30*b*, which shows the outer contour of a polygon, in the present case an octagon. At the end of the second cylindrical section 32 facing the second part 40 a collar 34 is arranged, extending outwardly, which is formed in a particular circumferential fashion (cf. particularly FIGS. 7 to 10). While the polygonal contour of the second cylindrical section 32 represents a torque-proofing measure between the first part 30 and the second part 40, the collar 34 represents a lock of the first part 30 and the second part 40 in the axial direction.

Figure 6:
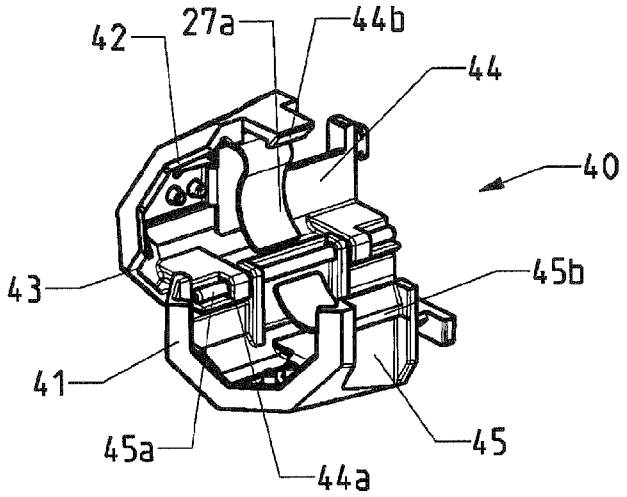
FIG. 6 is a line drawing evidencing a perspective view of the second part of the cable sheath of the plug-in connector according to FIG. 1 in a folded open state.
Figure 7:
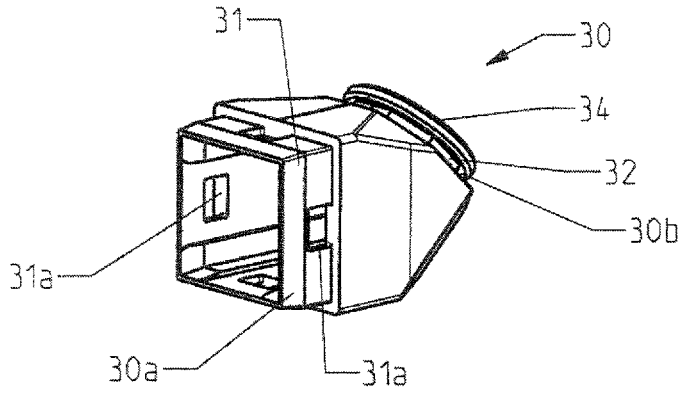
FIG. 7 is a line drawing evidencing a perspective view of the first part of the cable sheath of the plug-in connector according to FIG. 1.
Figure 8:
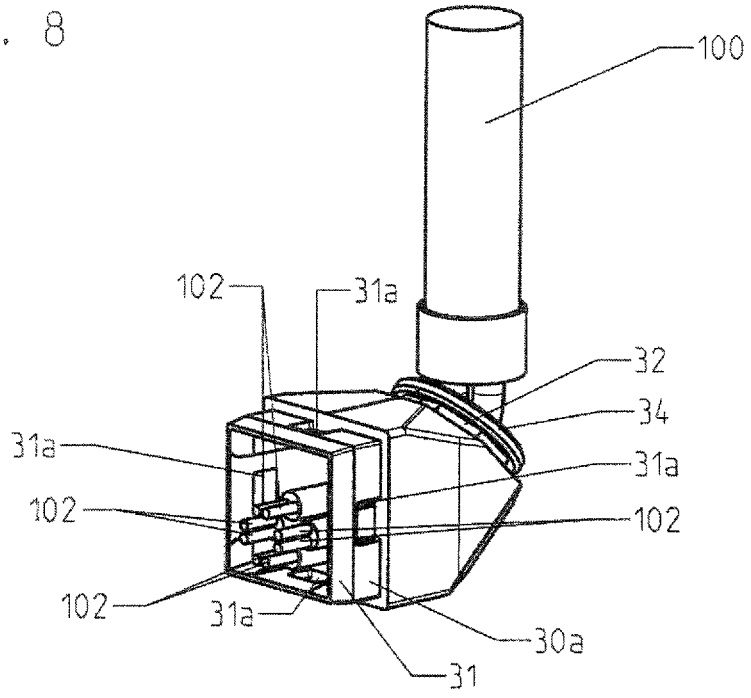
FIG. 8 is a line drawing evidencing a perspective view of the first part of the cable sheath with an inserted cable.

The second part 40, which is shown particularly in FIG. 6, shows a second contact area 41 facing the first part 30, which is arranged at a second angle $\alpha$2 from 0° and 90°, particularly at an angle of 45°, in reference to the second longitudinal axis L2 (cf. FIG. 17). In other words, the front end 40*a* facing the first part 30 is slanted with regard to the second longitudinal axis L2, particularly at an angle of 45°. In the area of the front end 40*a* the second part 40 shows a second contact area 41, which contacts the first contact area 33 when the second part 40 is fastened at the first part 30.

The second part 40 can be fixed at the first part 30 in several positions, distorted about the rotary axis A, particularly eight different positions (cf. also FIGS. 1 to 5). The rotary axis A is particularly aligned essentially perpendicular in reference to the first contact area 33 and to the second contact area 41. In order to fasten the second part 40 at the first part 30, the second part 40 comprises a cylindrical section 42 with an inner contour of a tetragon, preferably an octagon (cf. FIG. 6), which contacts the second cylindrical section 32 when the second part 40 is fastened at the first part 30. The contour of an octagon allows a relative positioning between the first part 30 and the second part 40, particularly in eight different positions. Such a contour is particularly robust and torque-proof, when both parts 30, 40 are made from metal.

The second part 40 comprises a collar 43 in the area of its front end 40*a*, projecting inwardly, which engages behind the collar 34 of the first part 30 when the second part 40 is fastened at the first part 30 and this way allows a fixation in the axial direction (cf. FIGS. 17 and 18). In the present case, the cylindrical section 42 is particularly embodied at the collar 43.

The first part 30 is preferably formed out of one piece. In order to allow fastening of the second part 40 at the first part 30 in one embodiment, the second part 40 comprises two elements 44, 45, pivotal in reference to each other around a swivel fitting. The axis of the swivel fitting ex-tends particularly parallel in reference to the second longitudinal axis L2. The swivel fitting is, for example, formed by a joint, which in one embodiment comprises a penetrating opening 44*a* arranged at the first element 44 and a pin 45 fastened at the second element 45, guided through the penetrating opening 44*a*. The two elements 44, 45 can be formed as half-shells, which con-tact each other particularly at an axial section, which comprises the second longitudinal axis L2. Such a second part 40 embodied from two parts makes it possible to push the cable 100 with the wires 102 first through the first part 30, fasten it at the notched housing 16, and subsequently place the second part 40 over the cable 100. Additionally, a wide opening of the two elements 44, 45 relative to each other is made possible by the swivel fitting generated by the pin 45*a*, which on the one hand facilitates the insertion of the cable 100, however on the other hand also allows a strongly structured contour of the cylindrical section 42 of the second part 40, which allows a torque-proof connection to the respective cylindrical section 32 of the first part 30.

The two elements 44, 45 are fixed to each other by a latching connection, in a single form. For this purpose, a latching hook 40*b* is arranged at the first element 44, which latches behind a latch projection arranged at the second element 45. The two elements 44, 45 may be produced from metal.

In order to be able to guide the cable outlet in the desired direction, the second part 40 is rotated about the rotary axis A into the desired position, the two elements 44, 45 are closed towards each other such that the cylindrical section 42 engages the second cylindrical section 32 of the first part 30 and the latching connection of the second part 40 engages.

Figure 3:
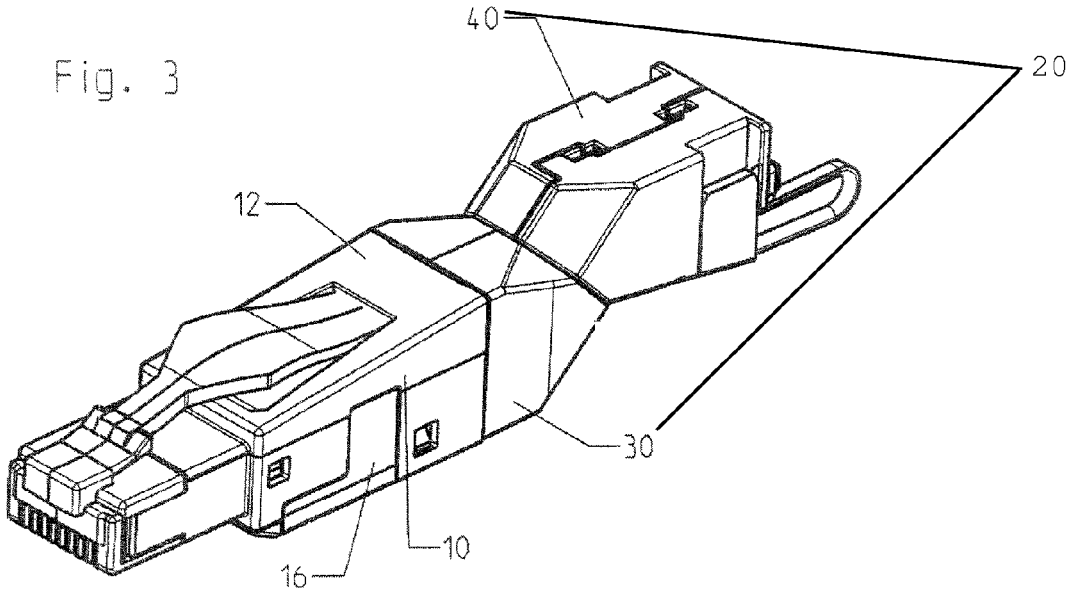
FIG. 3 is a line drawing evidencing the plug-in connector according to FIG. 1 with the second part of the cable sheath in an alternative position.
Figure 4:
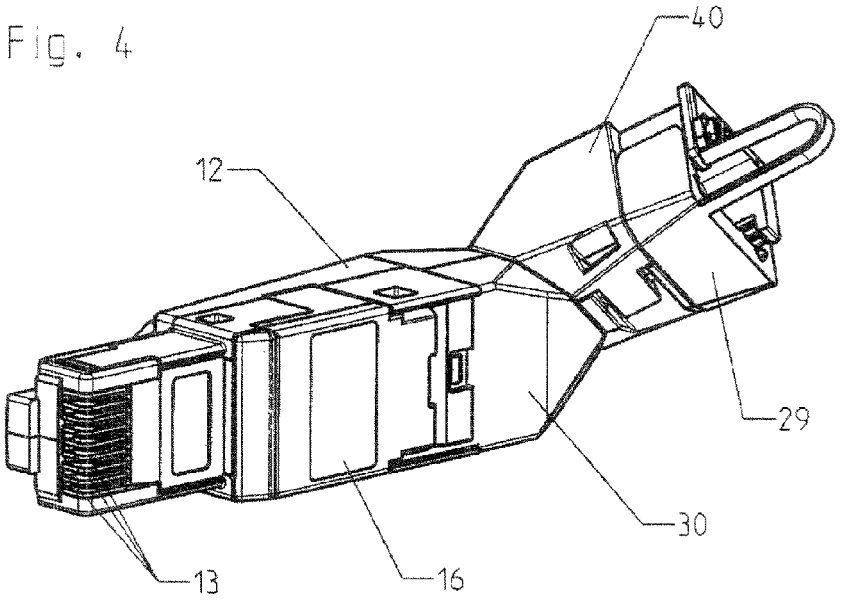
FIG. 4 is a line drawing evidencing the plug-in connector according to FIG. 1 with the second part of the cable sheath in another alternative position.
Figure 5:
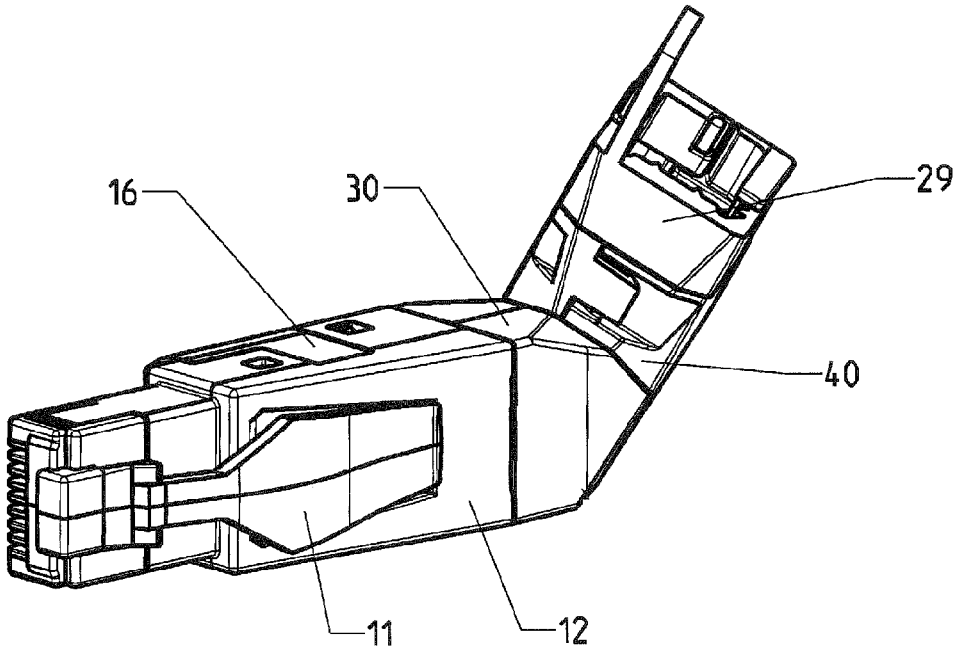
FIG. 5 is a line drawing evidencing the plug-in connector according to FIG. 1 with the second part of the cable sheath in another alternative position.

FIG. 1 shows the plug-in connector 10 with a cable outlet at an angle of 90° towards the top, FIG. 3 shows the plug-in connector 10 with the cable outlet towards the rear in an extension of the plug-in direction, FIG. 4 shows the plug-in connector with the cable outlet aligned 45° towards the bottom left, and FIG. 5 shows the plug-in connector 10 with the cable outlet aligned 45° to-wards the top right. Overall, various cable outlet options develop by the variable fastening options of the first part 30 in reference to the plug-in connector 10 and the second part 40 in reference to the first part 30, 32. In spite of the case in which the cable outlet extends towards the rear in an extension of the plug-in direction, with the first longitudinal axis L1 extending parallel with regard to the second longitudinal axis L2, the first longitudinal axis L1 and the second longitudinal axis L2 extend at an angle 0° different from each other.

Figure 2:
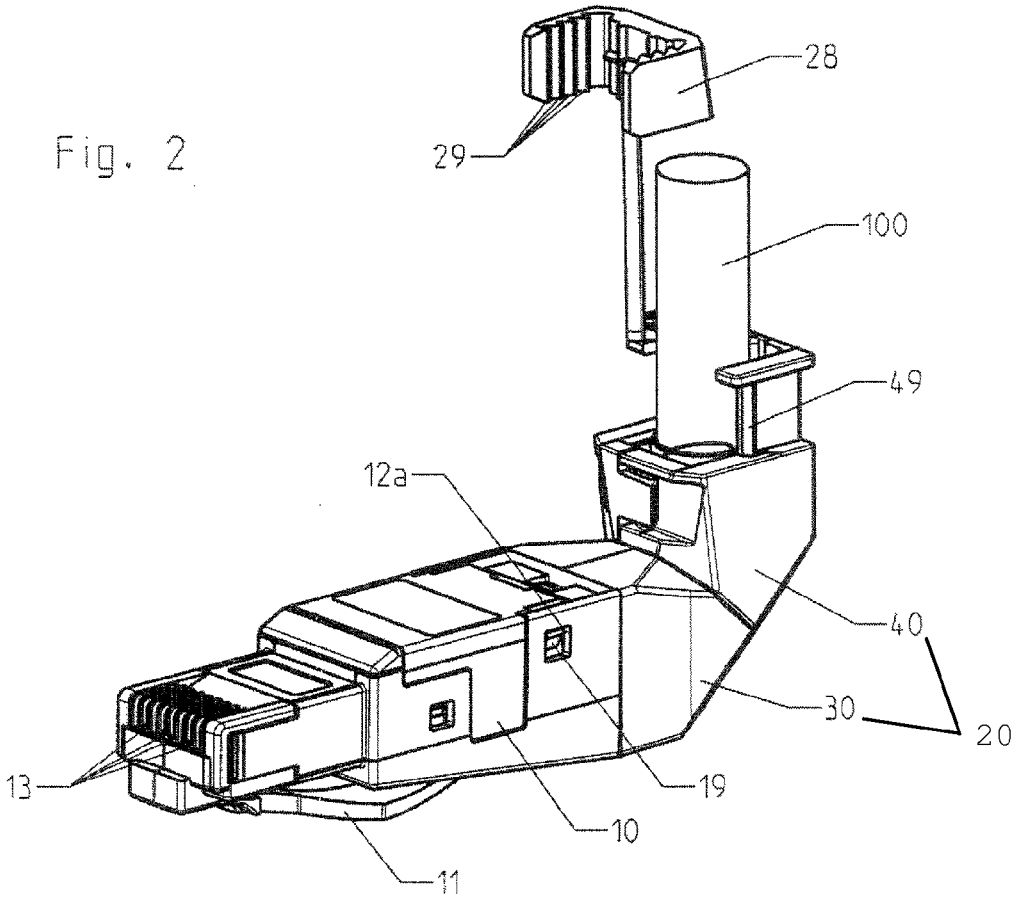
FIG. 2 is a line drawing evidencing a plug-in connector according to FIG. 1 with an opened strain relief claw.

The cable sheath 20 can feature a strain relief claw 28, which is fastened, for example, at the second part 40 and engages with latching teeth 29 behind an appropriate latching edge 49 ar-ranged at the second part 40 (see particularly FIGS. 1 and 2). The sheath of the cable 100 is fixed thereby and released of any tension.

In one form the cable sheath 20 may be made from an electrically-conductive material and act as a screen. The cable sheath 20 ideally comprises a screen removal spring 27*a* here, which is arranged at the second part 40 in order to remove the screen from the cable 100 as well as preferably a screen transfer spring 27*b*, which may be arranged at the first part 30 or alternatively, as shown in FIGS. 17 and 18, at the contact carrier 12 of the plug-in connector 10 in order to transfer the screen from the cable sheath 20 to the plug-in connector 10 (cf. FIGS. 17 and 18). The screen removal spring 27*a* is particularly arranged within the second part 40 and may be embodied as a curved flat spring, which advantageously contacts the cable 100. The arrangement of the screen removal spring 27*a* in the second part 40 allows the removal of the insulation and the cable screen of the cable 100 already in the second part, so that any kinking of the insulation and the cable screen can be avoided at the transition of the cable 100 from the second part 40 to the first part 30.

It shall be observed during the connection of the cable 100 that the sheath of the cable 100 projects into the second part 40, however it does not end here but is guided further into the first part 30 such that the cable sheath 20 can bend the wires 102 without worsening the transmitting characteristics of the conductor through any kinking of the cable sheath.

LIST OF REFERENCE NUMBERS

10 Plug-in connector
11 Latching lever
12 Contact carrier
12*a* Latch recess
13 Connection contact
14 Circuit board
15 Connecting contact
16 Notched housing
17 Notch
17*a* Groove
17*b* Penetration
18 Slot
19 Latching projection
19*a* Latching projection
20 Cable sheath
27*a* Screen removal spring
27*b* Screen transfer spring
28 Strain relief claw
29 Latching cam
30 first part
30*a* front end
30*b* rear end
31 first cylindrical section
31*a* latch opening
32 second cylindrical section
33 first contact area
34 collar
40 second part
40*a* front end
40*b* rear end
41 second contact area
42 cylindrical section
43 collar
44 first element
44*a* penetrating opening
44*b* latching edge
45 second element
45*a* pin
45*b* latching projection
49 latching edge
100 Cable
102 Wire
L1 first longitudinal axis
L2 second longitudinal axis
A rotary axis
α1 first angle
α2 second angle The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

We claim:

1. A plug-in connector for a data and/or telecommunication cable comprising several wires with a contact carrier, comprising connection contacts for a plug-in connection and with connecting contacts, connected thereto in an electrically-conducting fashion for the wires of the cable, and with an notched housing, which comprises notches for the wires, whereby during the assembly of the contact carrier and the notched housing an electrically-conductive contact is established between the wires arranged in the notches and the connecting contacts, wherein a cable sheath is arranged at the plug-in connector, which comprises a first part and a second part, with the first part showing a first longitudinal axis and the second part a second longitudinal axis, with the first part being fixed in reference to plug-in connector in at least two different positions, distorted about the first longitudinal axis, with the second part being fixed in reference to the first part in at least two different positions, distorted about a rotary axis, and with the first longitudinal axis and the second longitudinal axis being arranged in at least one of the different fixed positions of the cable sheath at an angle of 0° in reference to each other.

2. The plug-in connector of claim 1, wherein the first part comprises a first contact area for contacting the second part and that the second part comprises a second contact area for contacting the first part, with the first contact area being arranged at a first angle from 0° to 90° in reference to the first longitudinal axis and with the second contact area being arranged at a second angle from 9° to 90° in reference to the second longitudinal axis.

3. The plug-in connector of claim 2, wherein the rotary axis extends perpendicular to the first contact area and/or the second contact area.

4. The plug-in connector of claim 2, wherein the first angle and/or the second angle range from 30° to 60°, preferably comes to approximately 45°.

5. The plug-in connector of claim 1, wherein the first part is fixed at the plug-in connector in four different positions distorted about the first longitudinal axis.

6. The plug-in connector of claim 1, wherein the first part comprises at its end facing the plug-in connector a cylindrical section with a cross-section showing at least a two-fold rotary axis, preferably an essentially square cross-section.

7. The plug-in connector of claim 1, wherein the first part is fixed at the plug-in connector via a latching connection.

8. The plug-in connector of claim 1, wherein the second part is fixed at the first part in four to twelve, preferably in eight different positions, distorted about the rotary axis.

9. The plug-in connector of claim 1, wherein one of the two parts shows at its end facing the other one of the two parts a cylindrical section with an outer or inner contour with at least a two-fold rotary axis, preferably a polygon, particularly an octagon, and the other of the two parts comprises at its end facing one of the two parts a cylindrical section complementary to the cylindrical section of one of the two parts.

10. The plug-in connector of claim 1, wherein at least one of the two parts shows two elements, pivotal in reference to each other about a pivotal axis, which extends particularly parallel in reference to the second longitudinal axis.

11. The plug-in connector of claim 10, wherein each of the two elements shows a partial section of a cylindrical section.

12. The plug-in connector of claim 10, wherein the two elements are connected via a latching connection.

13. The plug-in connector of claim 10, wherein the two elements are connected to each other via a pin.

14. The plug-in connector of claim 1, wherein one of the two parts shows a collar extending outwardly and that the other one of the two parts shows a collar extending inwardly.

15. The plug-in connector of claim 1, wherein a cable guiding sheath, particularly the second part of the cable guiding sheath, comprises a strain relief.

16. The plug-in connector of claim 1, wherein the cable guiding sheath is embodied in an electrically conductive fashion.

17. The plug-in connector of claim 1, wherein the cable guiding sheath, particularly the second part of the cable guiding sheath, comprises a screen removal spring.

18. The plug-in connector of claim 1, wherein the cable guiding sheath, particularly the first part of the cable guiding sheath, comprises a screen transfer spring.

* * * * *